US010344638B2

(12) United States Patent
Sasaki et al.

(10) Patent No.: US 10,344,638 B2
(45) Date of Patent: Jul. 9, 2019

(54) INTERNAL COMBUSTION ENGINE SYSTEM

(71) Applicant: TOYOTA JIDOSHA KABUSHIKI KAISHA, Toyota-shi, Aichi-ken (JP)

(72) Inventors: Keisuke Sasaki, Susono (JP); Noriyasu Adachi, Numazu (JP); Shigehiro Sugihira, Susono (JP); Takayoshi Kawai, Susono (JP); Shinji Sadakane, Susono (JP); Hiroyuki Sugihara, Suntou-gun (JP); Kaoru Ohtsuka, Mishima (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 13 days.

(21) Appl. No.: 15/864,656

(22) Filed: Jan. 8, 2018

(65) Prior Publication Data

US 2018/0252125 A1 Sep. 6, 2018

(30) Foreign Application Priority Data

Mar. 3, 2017 (JP) ..... 2017-040624

(51) Int. Cl.

*F01L 13/00* (2006.01)
*F01L 1/047* (2006.01)
*F01L 1/053* (2006.01)

(52) U.S. Cl.

CPC ..... *F01L 13/0036* (2013.01); *F01L 1/047* (2013.01); *F01L 1/053* (2013.01); *F01L 2013/0052* (2013.01); *F01L 2013/101* (2013.01); *F01L 2013/113* (2013.01); *F01L 2013/116* (2013.01); *F01L 2250/02* (2013.01); *F01L 2250/04* (2013.01)

(58) Field of Classification Search

CPC ..... F01L 2001/0473; F01L 1/267; F01L 1/46; F01L 2013/0052; F01L 2820/031
USPC ..... 123/90.18, 90.27
See application file for complete search history.

(56) References Cited

U.S. PATENT DOCUMENTS

2010/0269769 A1 10/2010 Schoeneberg et al.
2012/0222635 A1 9/2012 Sunada et al.
2016/0298507 A1* 10/2016 Nestoriuc ..... F01L 13/0036

FOREIGN PATENT DOCUMENTS

DE 10 2004 027 966 A 1/2006
JP 5404427 B2 1/2014
WO 2011/064852 A1 6/2011

* cited by examiner

*Primary Examiner* — Jorge L Leon, Jr.
(74) *Attorney, Agent, or Firm* — Sughrue Mion, PLLC

(57) ABSTRACT

An internal combustion engine system is provided with a cam switching device including a cam groove provided on the outer peripheral surface or a camshaft and an actuator capable of protruding, toward the camshaft, an engagement pin that is engageable with the cam groove. The internal combustion engine system is configured, in causing the cam switching device to perform a cam switching operation, to control the actuator such that the engagement pin is seated on a forward outer peripheral surface which is located more forward than an end of the cam groove on the forward side with respect to an insert section of the cam groove in the rotational direction of the camshaft.

2 Claims, 7 Drawing Sheets

INTERNAL COMBUSTION ENGINE SYSTEM

CROSS-REFERENCE TO RELATED APPLICATION

This application is based on and claims the benefit of Japanese Patent Application No. 2017-040624, filed on Mar. 3, 2017, which is incorporated by reference herein in its entirety.

BACKGROUND

Technical Field

The present disclosure relates to an internal combustion engine system, and more particularly to an internal combustion engine system that includes a cam switching device that is capable of switching a cam that drives an intake valve or an exhaust valve that opens and closes a combustion chamber.

BACKGROUND ART

DE 102004027966 A1 discloses an internal combustion engine system that includes a cam switching device that is capable of selectively switching between a plurality of cams for driving a valve that opens and closes a combustion chamber. This cam switching device is provided with a cam groove (i.e., a spiral groove), an actuator and a cam carrier. The carrier is attached to a camshaft in such a manner as to be slidable in the axial direction of the camshaft. The cam groove is formed on an outer peripheral surface of this cam carrier. Moreover, the plurality of cams described above are fixed to the cam carrier. The actuator has an engagement pin that is capable of engaging with the cam groove, and is configured in such a way as to be capable of protruding the engagement pin toward the cam groove.

The cam switching device described above is configured such that, while the engagement pin is inserted into the cam groove by the operation of the actuator, the cam carrier slides in the axial direction of the camshaft in association with the rotation of the camshaft. Moreover, with the cam carrier sliding, the cam that drives the valve is switched.

In addition to DE 102004027966 A1, JP 5404427 B2 is a patent document which may be related to the present disclosure.

SUMMARY

As with an internal combustion engine system disclosed in DE 102004027966 A1, an internal combustion engine system is known which is provided with a cam switching device including a cam groove provided on an outer peripheral surface of a camshaft and an actuator capable of protruding, toward the camshaft, an engagement pin that is engageable with the cam groove. According to this kind of internal combustion engine, when the engagement pin is directly protruded into the cam groove in switching a cam, a collision noise occurs in connection with this protruding operation. A typical example of this kind of collision noise is exemplified by a seating noise that occurs when the engagement pin has been seated on the bottom surface of the cam groove. In addition, even if the actuator is configured in such a manner that the engagement pin does not come into contact with the bottom surface of the cam groove, the collision noise described above may occur when, for example, a part of the engagement pin comes into contact with a stopper in the actuator. In order to improve the quietness of the internal combustion engine, it is favorable to be able to suppress and reduce the collision noise as described above.

The present disclosure has been made to address the problem described above, and an object of the present disclosure is to provide an internal combustion engine system which is provided with a cam switching device including a cam groove provided on an outer peripheral surface of a camshaft and an actuator capable of protruding, toward the camshaft, an engagement pin that is engageable with the cam groove, which can suppress and reduce a collision noise that occurs in connection with the protruding operation of the engagement pin.

An internal combustion engine system according to the present disclosure includes:

a camshaft which is driven to rotate;

a plurality of cams which are provided at the camshaft and whose profiles are different from each other;

a cam switching device configured to perform a cam switching operation that switches, between the plurality of cams, a cam that drives a valve that opens and closes a combustion chamber; and a control device configured to control the cam switching device.

The cam switching device includes:

a cam groove which is provided on an outer peripheral surface of the camshaft; and an actuator which is equipped with an engagement pin engageable with the cam groove, and which is capable of protruding the engagement pin toward the camshaft.

The cam switching device is configured such that, while the engagement pin is engaged with the cam groove, the cam that drives the valve is switched between the plurality of cams in association with a rotation of the camshaft.

The outer peripheral surface of the camshaft includes a forward outer peripheral surface which is located more forward than an end of the cam groove on a forward side in a rotational direction of the camshaft.

The control device is configured, in causing the cam switching device to perform the cam switching operation, to control the actuator such that the engagement pin is seated on the forward outer peripheral surface.

In causing the cam switching device to perform the cam switching operation, the control device may be configured, when an engine speed is lower than a threshold value, to control the actuator such that the engagement pin is seated on the forward outer peripheral surface, and may be configured, when the engine speed is equal to or higher than the threshold value, to control the actuator such that the engagement pin is inserted into the cam groove without being seated on the forward outer peripheral surface.

The threshold value of the engine speed used when a temperature of an oil that lubricates the camshaft is a first temperature value may be smaller than that used when the temperature of the oil is a second temperature value that is greater than the first threshold value.

According to the internal combustion engine system of the present disclosure, in causing the cam switching device to perform the cam switching operation, the actuator is controlled such that the engagement pin is seated on the forward outer peripheral surface. As a result, the engagement pin is seated on the forward outer peripheral surface and then inserted into an insert section of the cam groove as a result of the rotation of the camshaft. With the engagement pin being temporarily seated on the forward outer peripheral surface in this way, the stroke amount of the engagement pin can be reduced when the engagement pin is thereafter protruded toward the insert section of the cam groove from the forward outer peripheral surface. Furthermore, the protruding speed of the engagement pin becomes zero temporarily when the engagement pin is seated on the forward outer peripheral surface. Due to these reasons, the protruding speed can be decreased when the engagement pin is inserted into the cam groove thereafter. Therefore, according to the internal combustion engine system of the present disclosure, a collision noise that occurs in connection with the protruding operation of the engagement pin can be suppressed and reduced.

DETAILED DESCRIPTION

In the following, embodiments of the present disclosure are described with reference to the accompanying drawings. However, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Further, structures or steps or the like that are described in conjunction with the following embodiments are not necessarily essential to the present disclosure unless explicitly shown otherwise, or unless the present disclosure is explicitly specified by the structures, steps or the like theoretically.

First Embodiment

First, a first embodiment according to the present disclosure will be described with reference to FIGS. 1 to 6.

1. Configuration of Internal Combustion Engine System According to First Embodiment An internal combustion engine which an internal combustion engine system according to the present embodiment includes is mounted in a vehicle, and is used as a power source thereof. The internal combustion engine according to the present embodiment is a four-stroke in-line four-cylinder engine, as an example. The firing order of this internal combustion engine is a first cylinder #1 to a third cylinder #3, to a fourth cylinder #4 and to a second cylinder #2, as an example.

Figure 1:
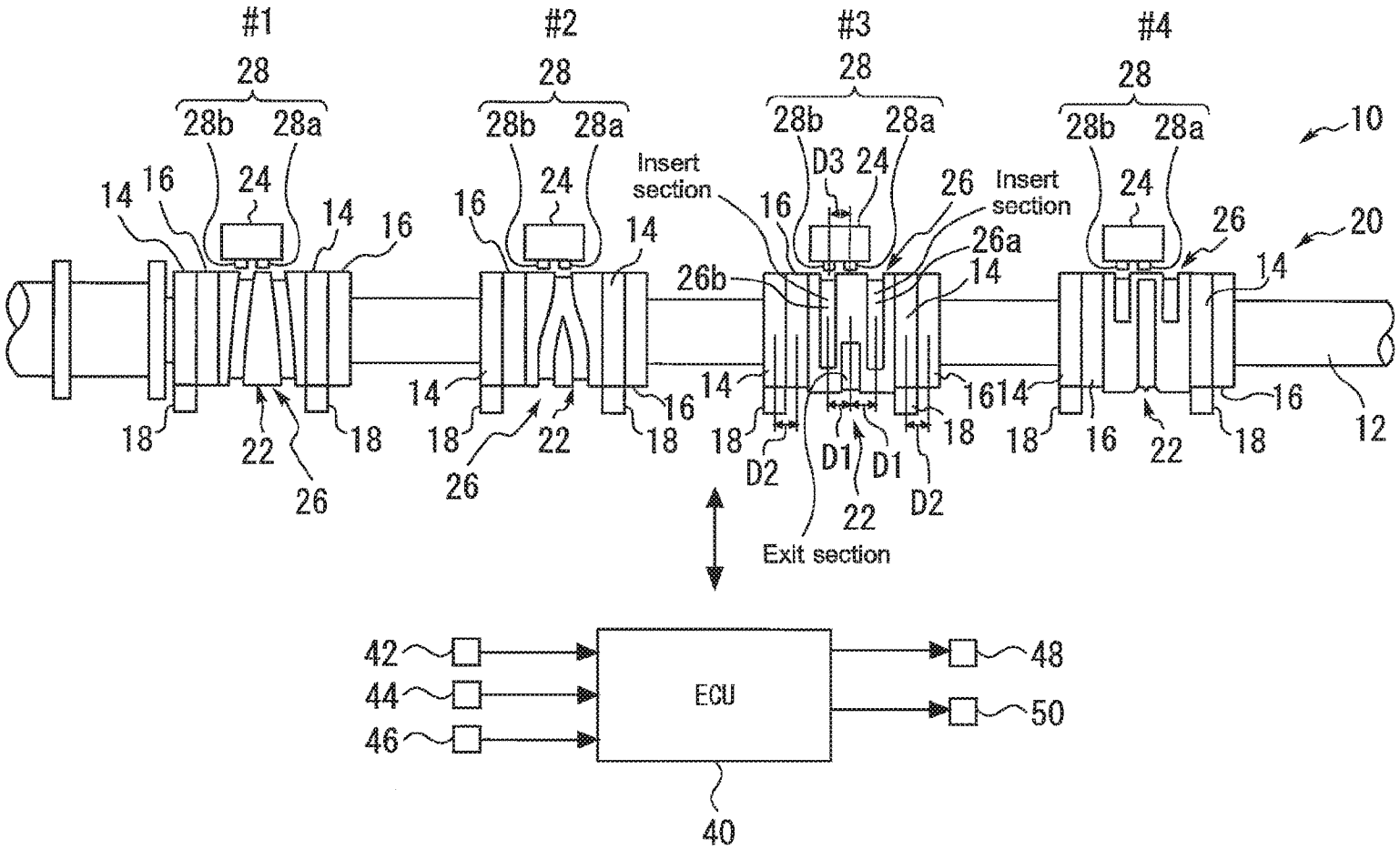
FIG. 1 is a diagram that schematically illustrates a configuration of a main part of a valve train of an internal combustion engine system according to a first embodiment of the present disclosure.

FIG. 1 is a diagram that schematically illustrates a configuration of a main part of a valve train of the internal combustion engine system according to the first embodiment of the present disclosure. In the internal combustion engine of the present embodiment, two intake valves (not shown in the drawing) are provided for each cylinder, as an example. Moreover, the internal combustion engine is provided with a variable valve operating device 10 for driving these two intake valves. In addition, the variable valve operating device 10 described below is applicable to a valve that opens and closes a combustion chamber, and thus, it may be used to drive an exhaust valve, instead of the intake valve.

1-1. Camshaft

The variable valve operating device 10 is equipped with a camshaft 12 for driving the intake valves for each cylinder. The camshaft 12 is connected to a crankshaft (not shown in the drawing) via a timing pulley and a timing chain (or a timing belt) which are not illustrated, and is driven to rotate at half of the speed of the crankshaft by the torque of the crankshaft.

1-2. Intake Cam

The variable valve operating device 10 is equipped with a plurality of (as an example, two) intake cams 14 and 16 whose profiles are different from each other and which are provided for the respective intake valves in each cylinder. The intake cams 14 and 16 are attached to the camshaft 12 in a manner described later. The profile of the intake cam 14 is set such that the intake cam 14 serves as a "small cam" for obtaining, as the lift amount and the operating angle (i.e., the crank angle width in which the intake valve is open) of the intake valve, a lift amount and an operating angle that are relatively smaller. The profile of the remaining intake cam 16 is set such that the intake cam 16 serves as a "large cam" for obtaining a lift amount and an operating angle that are greater than the lift amount and the operating angle obtained by the intake cam 14. It should be noted that one of the profiles of the plurality of intake cams may have only a base circle section in which the distance from the axis of the camshaft 12 is constant. That is, one of the intake cams may also be set as a zero lift cam which does not give a pressing three to the intake valve.

A rocker arm 18 for transmitting a pressing force from the intake cam 14 or 16 to the intake valve is provided for each of the intake valves. FIG. 1 shows an operating state in which the intake valves are driven by the intake cams (small cams) 14. Thus, in this operating state, each of the intake cams 14 is in contact with the corresponding rocker arm 18 (more specifically, a roller of the rocker arm 18).

1-3. Cam Switching Device

The variable valve operating device 10 is further equipped with a cam switching device 20. The cam switching device 20 performs a cam switching operation by which the cam that drives the intake valve (in other words, the cam that is to be mechanically connected to the intake valve) is switched between the intake cams 14 and 16. The cam switching device 20 is equipped with a cam carrier 22 and an actuator 24 for each cylinder.

The cam carrier 22 is supported by the camshaft 12 in a form that the cam carrier 22 is slidable in the axial direction of the camshaft 12 and that the movement of the cam carrier 22 in the rotational direction of the camshaft 12 is restricted. As shown in. FIG. 1, two pairs of intake cams 14 and 16 for driving two intake valves in the same cylinder are formed on the cam carrier 22. Also, the intake cams 14 and 16 of each pair are disposed adjacently to each other. Moreover, a cam groove 26 is formed on the outer peripheral surface of each cam carrier 22 that corresponds to a part of the outer peripheral surface of the camshaft 12.

(Cam Groove)

Figures 2A, 2B:
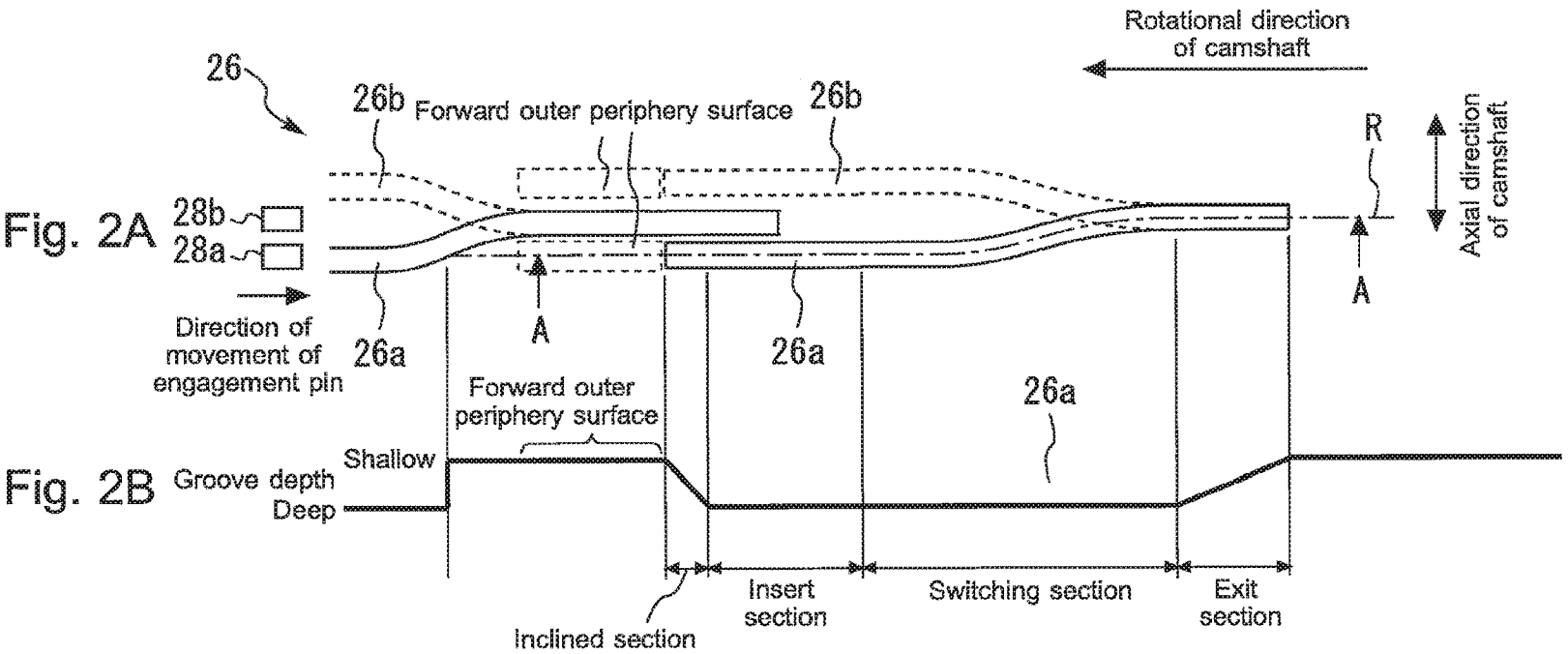
FIGS. 2A and 2B are views for describing a concrete configuration of a cam groove shown in FIG. 1.

FIGS. 2A and 2B are views for describing a concrete configuration of the cam groove 26 shown in FIG. 1. More specifically, FIG. 2A is a view obtained by developing, on a plane, the cam groove 26 formed in the outer peripheral surface of the cam carrier 22. The cam groove 26 is provided as a pair of cam grooves 26*a* and 26*b* corresponding to a pair of engagement pins 28*a* and 28*b* described in detail later. It should be noted that, since the movement of the engagement pin 28 with respect to the cam groove 26 is based on the rotation of the camshaft 12, the direction of the movement is a direction opposite to the rotational direction of the camshaft 12 as shown in FIG. 2A.

Each pair of cam grooves 26*a* and 26*b* is formed so as to extend in the circumferential direction of the camshaft 12, and paths of the cam grooves 26*a* and 26*b* join to each other as shown in FIG. 2A. In more detail, the cam grooves 26*a* and 26*b* are respectively provided corresponding to the engagement pins 28*a* and 28*b*, and each of them includes an "insert section" and a "switching section".

Each of the insert sections is formed so as to extend in a "perpendicular direction" that is perpendicular to the axial direction of the camshaft 12 and such that one of the engagement pins 28*a* and 28*b* is inserted thereinto. The switching section is formed so as to be continuous with one end of the insert section at a location on the rear side with respect to the insert section in the rotational direction of the camshaft 12 and to extend in a direction that is inclined with respect to the perpendicular section. The switching section is provided so as to fall within a section (i.e., a base circle section) in which neither of the intake cams 14 and 16 provided at the cam carrier 22 on which the cam groove 26 having this switching section is formed does not lift the respective intake valves. The switching section of the cam groove 26*a* and the switching section of the cam groove 26*b* are oppositely inclined to each other with respect to the axial direction of the camshaft 12. Moreover, a shared portion of the cam grooves 26*a* and 26*b* in which the paths thereof join corresponds to an "exit direction" in which the engagement pin 28 exits from the cam groove 26.

In FIG. 2A, a movement route R of the engagement pin 28 in association with the rotation of the camshaft 12 is shown. FIG. 2B is a longitudinal sectional view of the cam groove 26*a* that is obtained by cutting the cam carrier 22 along an A-A line in FIG. 2A (that is, along the movement route R of the engagement pin 28). In addition, the longitudinal sectional view of the cam groove 26*b* is also similar to this. As shown in FIG. 2B, the groove depths of the insert section and the switching section are constant, as an example. On the other hand, the groove depth of the exit section is not constant and becomes smaller gradually when the position of the groove comes closer to an end of the exit section on the rear side in the rotational direction of the camshaft 12. It should be noted that the cam grooves 26 of the individual cylinders are formed with a phase difference of 90 degrees in cam angle between the adjacent cylinders in order according to the firing order described above.

Moreover, as shown in FIG. 2B, an outer peripheral surface of the cam carrier 22 that corresponds to a part of the outer peripheral surface of the camshaft 12 is located on the forward side with respect to the insert section of the cam groove 26*a* in the rotational direction of the camshaft 12. The outer peripheral surface that is present at this location is herein referred to as a "forward outer peripheral surface", for convenience of explanation. As shown in FIG. 2A, a similar forward outer peripheral surface is also present in the vicinity of the cam groove 26*b*.

It should be noted that, in the example shown in FIGS. 2A and 2B, an "inclined section" in which the groove depth gradually changes is provided between the "forward outer peripheral surface" and the "insert section" of each of the cam grooves 26*a* and 26*b*. However, this kind of inclined section may not be always provided to the cam groove according to the present disclosure, and the border between the "forward outer peripheral surface" and the "insert section" may be continuous with each other in a step-wise fashion. In addition, in the cam groove 26 having the inclined section described above, an end of the inclined section on the forward side in the rotational direction of the camshaft 12 corresponds to an "end of the cam groove on the forward side in the rotational direction of the camshaft" according to the present disclosure. On the other hand, in a cam groove without the inclined section, an end of the insert section on the forward side in the rotational direction described above corresponds to this.

(Actuator)

The actuator 24 is fixed to a stationary member 27, such as a cylinder head, at a location that is opposed to the cam groove 26. The actuator 24 is equipped with the engagement pins 28*a* and 28*b* that are capable of engaging with the cam grooves 26*a* and 26*b*, respectively. The actuator 24 is configured in such a way as to be capable of selectively protruding one of the engagement pins 28*a* and 28*b* toward the camshaft 12 (more specifically, toward the cam groove 26).

It should be noted that, as a premise of the cam switching operation, the following positional relation is met among the pair of intake cams 14 and 16, the pair of cam grooves 26*a* and 26*b*, and the pair of the engagement pins 28*a* and 28*b* as shown in FIG. 1. That is, a distance between a groove center line of the insert section of the cam groove 26*a* and a groove center line of the (shared) exit section of the cam grooves 26*a* and 26*b* is a distance D1 and is the same as a distance between a groove center line of the insert section of the cam groove 26*b* and the groove center line of the exit section. Moreover, this distance D1 is the same as each of a distance D2 between center lines of the pair of intake cams 14 and 16 and a distance D3 between center lines of the pair of engagement pins 28*a* and 28*b*.

Figure 3:
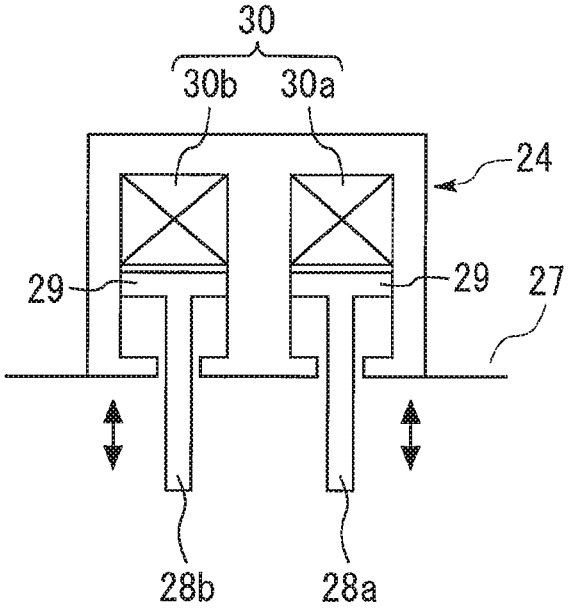
FIG. 3 is a diagram that schematically describes an example of a configuration of an actuator shown in FIG. 1.

FIG. 3 is a diagram that schematically describes an example of a configuration of the actuator 24 shown in FIG. 1. The actuator 24 according to the present embodiment is of an electromagnetic solenoid type, as an example. As shown in FIG. 3, the actuator 24 is equipped with an electromagnet (a pair of electromagnets 30*a* and 30*b*) for the pair of the engagement pins 28*a* and 28*b*. The engagement pin 28 is built into the actuator 24. The engagement pin 28 has a plate-like portion 29 that is located at an end of the engagement pin 28 on the side opposed to the electromagnet 30 and that is formed by a magnetic material. Control of energization to the actuator 24 (the electromagnet 30) is performed on the basis of a command from an electronic control unit (ECU) described later. The actuator 24 is configured such that, when the energization to the electromagnet 30 is performed, the engagement pin 28 reacts against the electromagnet 30 and is protruded toward the camshaft 12 (the cam carrier 22). Thus, with the energization to the actuator 24 being performed at an appropriate timing described in detail later, the engagement pin 28 can be engaged with the cam groove 26.

When the engagement pin 28 that is in engagement with the cam groove 26 enters into the exit section as a result of the rotation of the camshaft 12, the engagement pin 28 is displaced so as to be pushed back to the side of the electromagnet 30 by the effect of the bottom surface in which the groove depth becomes gradually smaller. If the engagement pin 28 is pushed back in this way, an induced electromotive force is generated at the electromagnet 30*b*. When this induced electromotive force is detected, the energization to the actuator 24 (the electromagnet 30) is stopped. As a result, the engagement pin 28 is attracted to the electromagnet 30, and the exit of the engagement pin 28 from the cam groove 26 is completed.

1-4. Control System

The internal combustion engine system according to the present embodiment is provided with the ECU 40 as a control device. Various sensors installed in the internal combustion engine and the vehicle on which the internal combustion engine is mounted and various actuators for controlling the operation of the internal combustion engine are electrically connected to the ECU 40.

The various sensors described above include a crank angle sensor 42, an oil temperature sensor 44 and an air flow sensor 46. The crank angle sensor 42 outputs a signal responsive to the crank angle. The ECU 40 can obtain an engine speed by the use of the crank angle sensor 42. The oil temperature sensor 44 outputs a signal responsive to the temperature of an oil that lubricates each part of the internal combustion engine (which includes each part (such as, the camshaft 12) of the variable valve operating device 10). The air flow sensor 46 outputs a signal responsive to the flow rate of air that is taken into the internal combustion engine. Moreover, the various actuators described above include fuel injection valves 48 and an ignition device 50 as well as the actuators 24.

The ECU 40 includes a processor, a memory, and an input/output interface. The input/output interface receives sensor signals from the various sensors described above, and also outputs actuating signals to the various actuators described above. In the memory, various control programs and maps for controlling the various actuators are stored. The processor reads out a control program from the memory and executes the control program. As a result, the function of the "control device" according to the present embodiment is achieved.

2. Cam Switching Operation

Next, the cam switching operation with the cam switching device 20 will be described with reference to FIG. 4. Which of the intake cam (small cam) 14 and the intake cam (large cam) 16 is used as the cam that drives the intake valve is determined, for example, in accordance with the engine operating condition (mainly, the engine load and the engine speed) and the magnitude of a change rate of a required torque from the driver.

2-1. Cam Switching Operation from Small Cam to Large Cam

Figure 4:
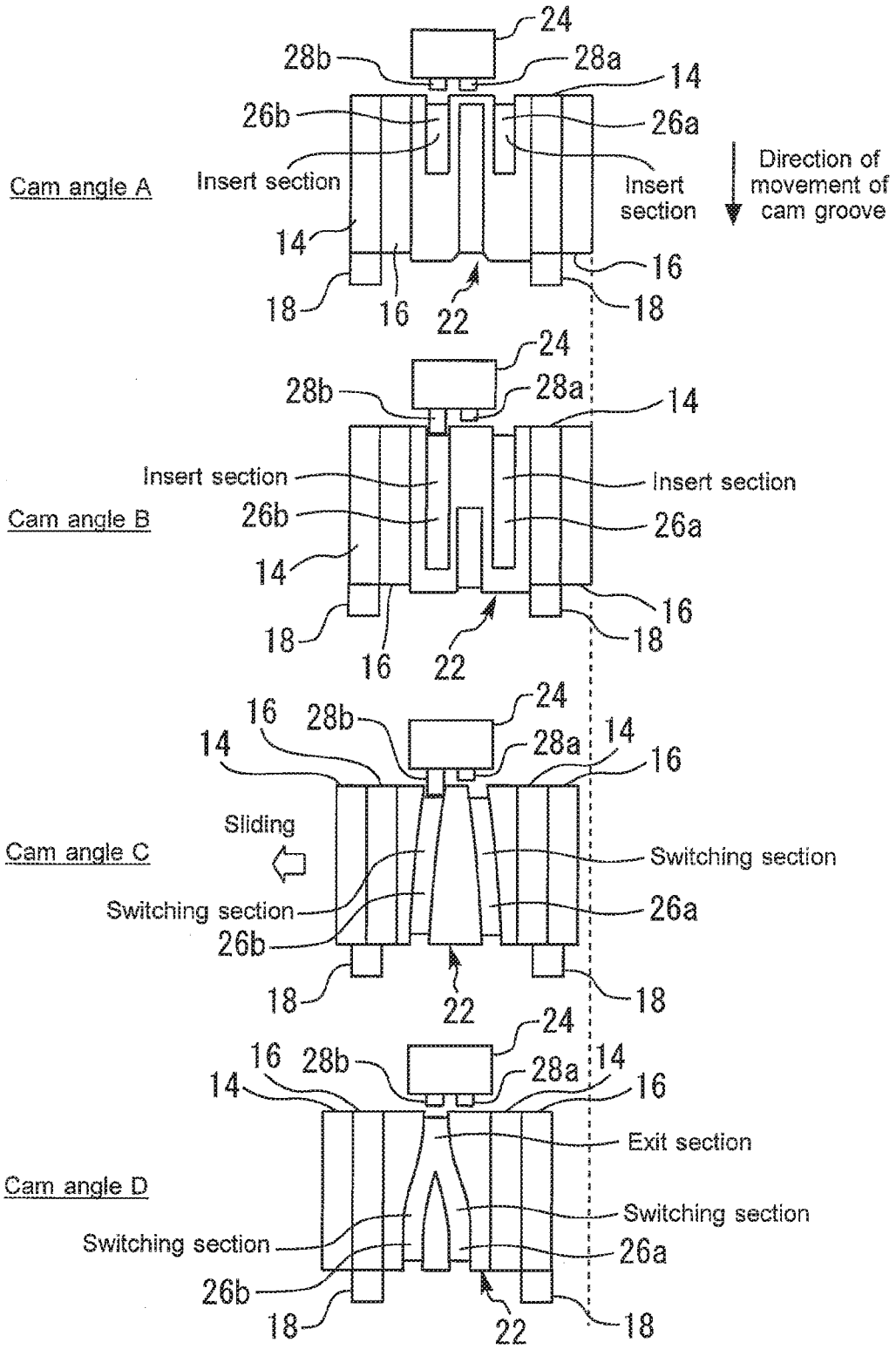
FIG. 4 is a diagram for describing an example of a cam switching operation by a cam switching device.

FIG. 4 is a diagram for describing an example of the cam switching operation by the cam switching device 20. In more detail, the example shown in FIG. 4 corresponds to the cam switching operation performed such that the cam that drives the valve is switched from the intake cam (small cam) 14 to the intake cam (large cam) 16. In FIG. 4, the cam carrier 22 and the actuator 24 at each of cam angles A to D are represented. It should be noted that, in FIG. 4, the cam groove 26 moves from the upper side toward the lower side in FIG. 4 in association with the rotation of the camshaft 12.

In the cam angle A in FIG. 4, the cam carrier 22 is located on the camshaft 12 such that the insert section of the cam groove 26*b* is opposed to the engagement pin 28*b*. In this cam angle A, the energization to the electromagnets 30*a* and 30*b* of the actuator 24 is not performed. Also, in the cam angle A, each of the rocker arms 18 is in contact with the intake cam 14.

The cam angle B in FIG. 4 corresponds to a cam angle obtained when the camshaft 12 is rotated by 90 degrees from the cam angle A. As a result of the engagement pin 28*b* being protruded toward the camshaft 12 (the cam carrier 22) in response to execution of the energization to the actuator 24 (the electromagnet 30*b*), the engagement pin 28*b* is engaged with the cam groove 26*b* in the insert section. As shown in FIG. 4, in the cam angle B, the engagement pin 28*b* is engaged with the cam groove 26*b* in the insert section.

The cam angle C in FIG. 4 corresponds to a cam angle obtained when the camshaft 12 is rotated further by 90 degrees from the cam angle B. The engagement pin 28*b* enters into the switching section via the insert section as a result of the rotation of the camshaft 12. As shown in FIG. 4, in the cam angle C, the engagement pin 28*b* is in engagement with the cam groove 26*b* in the switching section. Since the engagement pin 28 is located in the switching section in this way, the cam carrier 22 slides to the left side in FIG. 4 from the position corresponding to the cam angle B as a result of the rotation of the camshaft 12, as can be seen by comparing the cam angle B with the cam angle C in FIG. 4.

The cam angle D in FIG. 4 corresponds to a cam angle obtained when the camshaft 12 is rotated further by 90 degrees from the cam angle C. The engagement pin 28*b* enters into the exit section after having passed through the switching section. When the engagement pin 28*b* enters into the exit section, the engagement pin 28*b* is pushed back to the side of the electromagnet 30*b* by the effect of the bottom surface of the exit section as described above. If the engagement pin 28*b* is pushed back, the ECU 40 detects the induced electromotive force of the electromagnet 30*b* to stop the energization to the electromagnet 30*b*. As a result, the engagement pin 28*b* is attracted to the electromagnet 30*b*, and the exit of the engagement pin 28*b* from the cam groove 26*b* is completed. In FIG. 4, the cam carrier 22 and the actuator 24 at the cam angle D at which the exit of the engagement pin 28*b* from the cam groove 26*b* is completed are shown.

Moreover, in the cam angle D in FIG. 4, the sliding operation of the cam carrier 22 to the left side in FIG. 4 is also completed. Thus, the cam switching operation by which the cam that gives a pressing force to the rocker arm 18 is switched to the intake cam (large cam) 16 from the intake cam (small cam) 14 is completed. According to this kind of cam switching operation, switching of the cam can be performed while the camshaft 12 rotates one revolution.

In further addition to this, when the cam switching operation to the intake cam (large cam) 16 from the intake cam (small cam) 14 is completed, the remaining engagement pin 28*a* is opposed to the insert section of the remaining cam groove 26*a* as can be seen from the illustration concerning the cam angle D in FIG. 4.

2-2. Cam Switching Operation to Small Cam from Large Cam

Since the cam switching operation to the intake cam (small cam) 14 from the intake cam (large cam) 16 is similar to the above-described cam switching operation to the intake cam (large cam) 16 from the intake cam (small cam) 14, the description therefor is herein schematically made as follows.

That is, the cam switching operation to the intake cam (small cam) 14 from the intake cam (large cam) 16 is performed when the cam carrier 22 lies at a position similar to the illustration concerning the cam angle D in FIG. 4. First, the energization to the actuator 24 (the electromagnet 30*a*) is performed such that the engagement pin 28*a* is inserted into the insert section of the cam groove 26*a*. Thereafter, during the engagement pin 28*a* passing through the switching section, the cam carrier 22 slides to the right side in FIG. 4 as a result of the rotation of the camshaft 12. Then, when the engagement pin 28*a* has passed through the switching section, the sliding operation of the cam carrier 22 is completed, and the cam that gives a pressing force to the rocker arm 18 is switched to the intake cam (small cam) 14 from the intake cam (large cam) 16. Moreover, the exit of the engagement pin 28*a* from the cam groove 26*a* is performed. It should be noted that, when the cam switching operation is completed in this way, the position of the cam carrier 22 is returned to the position at which the engagement pin 28*b* is opposed to the insert section of the cam groove 26*b*, as with the illustration concerning the cam angle A in FIG. 4.

3. Energization Control of Actuator According to First Embodiment

3-1. Problem on Protruding Operation of Engagement Pin

Figure 5:
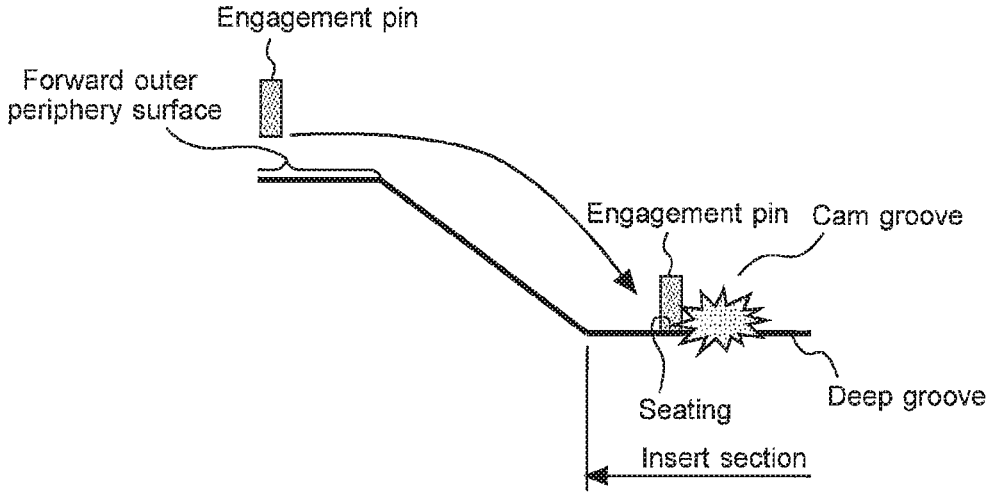
Fig. 5 RELATED ART
FIG. 5 is a diagram for describing a problem on a protruding operation of an engagement pin.

FIG. 5 is a diagram for describing a problem on a protruding operation of an engagement pin, and represents a typical protruding operation that is to be referred to for comparison with a method according to the present embodiment described later with reference to FIG. 6.

In a comparison example shown in FIG. 5, the engagement pin is seated on the bottom surface of an insert section of a cam groove as a result of the engagement pin being directly protruded into the cam groove in order to switch a cam. In the example in which the engagement pin is directly seated on the bottom surface of the cam groove in this way, the engagement pin is seated on the cam groove in a state in which the stroke of the engagement pin is great (i.e., in a state in which the speed of the engagement pin that is protruded is high). As a result, a collision noise (in this example, a seating noise) that accompanies the protruding operation becomes greater. Hereafter, a protruding operation performed in a mode in which the engagement pin is directly seated on the bottom surface of the insert section of the cam groove in this way is also referred to as a "deep-groove seating".

It should be noted that the example in which a collision noise occurs in connection with the protruding operation of the engagement pin when the engagement pin is seated on the bottom surface of the cam groove is herein taken with reference to FIG. 5. In regard to a point that the engagement pin is seated on the bottom surface of the cam groove when the engagement pin is inserted into the cam groove and that, as a result, a collision noise (a seating noise) occurs, the cam switching device 20 according to the present embodiment is similar to the comparison example described above. However, a collision noise that accompanies the protruding operation may also occur even if an actuator is configured such that the engagement pin is inserted into the cam groove in such a manner as not to come into contact with the bottom surface of the cam groove. If, for example, the actuator 24 shown in FIG. 3 is alternatively configured such that the plate-like portion 29 is seated on a wall surface on the side opposite to the electromagnet 30 without the engagement pin 28 being seated on the bottom surface of the cam groove 26, a collision noise (seating noise) occurs when the plate-like portion 29 is seated on the wall surface described above.

3-2. Manner of Protruding Operation of Engagement Pin According to First Embodiment (Outer-Periphery Seating)

Figure 6:
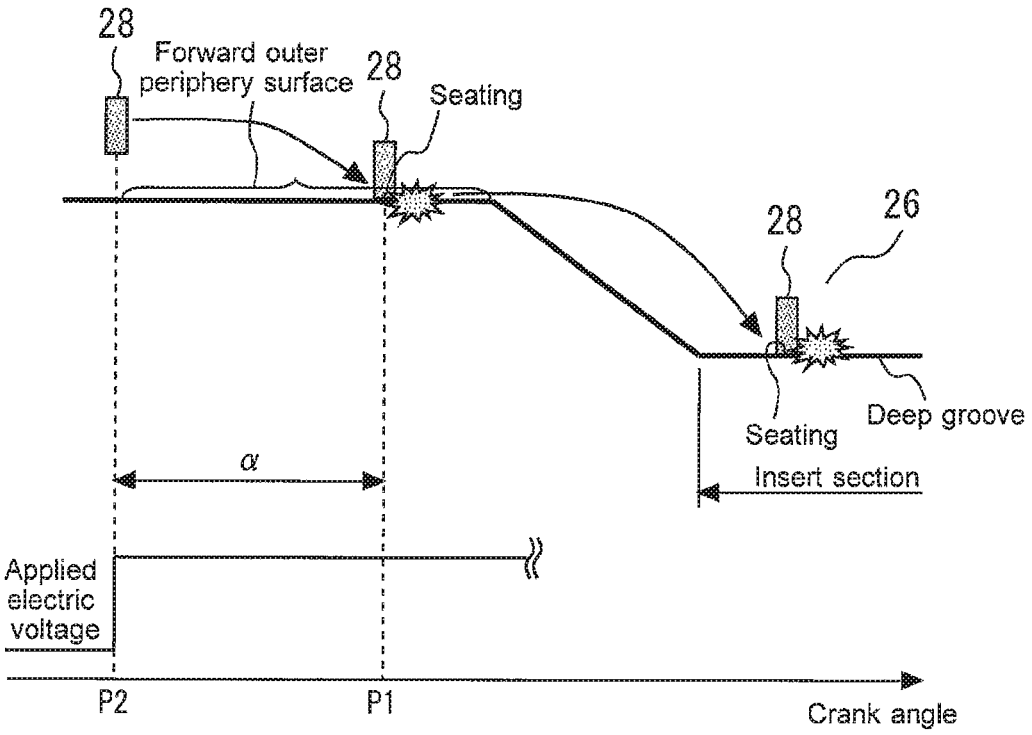
FIG. 6 is a diagram for describing a protruding operation of an engagement pin according to the first embodiment of the present disclosure.

FIG. 6 is a diagram for describing the protruding operation of the engagement pin 28 according to the first embodiment of the present disclosure. In the present embodiment, in switching the cam, the deep-groove seating as shown in FIG. 5 is not used, and, instead, the actuator 24 is controlled as shown in FIG. 6 such that the engagement pin 28 is seated on the "forward outer peripheral surface" (that is, an outer peripheral surface located on the forward side with respect to the insert section in the rotational direction of the camshaft 12). Hereafter, a method of seating performed in a manner as just described is referred to as an "outer-periphery seating".

3-3. Processing of ECU Concerning Energization Control of Actuator According to First Embodiment Specifically, the energization control of the actuator 24 (the electromagnet 30) for using the outer-periphery seating of the engagement pin 28 can be performed by the ECU 40 in a manner as described below, for example.

(Setting of Target Seating Position P1)

The ECU 40 first sets the target seating position P1 on the forward outer peripheral surface. As an example of the target seating position P1, a value (more specifically, a crank angle position) determined in advance in consideration of parameters, such as variation of the operation of the engagement pin 28, can be used.

(Estimation of Protruding Speed of Engagement Pin)

Next, the ECU 40 estimates the protruding speed of the engagement pin 28. As an example, the protruding speed is estimated on the basis of the temperature of the oil obtained with the oil temperature sensor 44 and an applied electric voltage of the actuator 24 (electromagnet 30). If the applied electric voltage is higher, the electric current that flows through the electromagnet 30 under the same resistance value of the electromagnet 30 becomes greater, and the protruding speed thus becomes greater. Moreover, since the temperature of the electromagnet 30 is proportional to the temperature of the oil described above, the temperature can be grasped on the basis of this oil temperature. If the temperature of the electromagnet 30 is higher, the resistance value of the electromagnet 30 becomes greater and, in accompaniment with this, the value of the electric current under the same applied electric voltage becomes smaller. Moreover, the oil described above is also present around the engagement pin. 28 in order to lubricate the parts of the variable valve operating device 10, such as the camshaft 12, and the oil is also attached to the engagement pin 28. Thus, the protruding speed is also affected by the viscosity of the oil. In more detail, if the oil temperature is lower, the viscosity of the oil becomes higher and the protruding speed thus becomes lower. In consideration of the points described so far, in the ECU 40, a map (not shown in the drawing) of the protruding speed that is associated with the oil temperature and the applied electric voltage is stored. By referring to this kind of map, the ECU 40 can estimate (obtain) the protruding speed of the engagement pin 28 according to the current oil temperature and the applied electric voltage.

(Setting of Energization Start Position P2)

Next, the ECU 40 sets an energization start position (more specifically, a crank angle position) P2 for the electromagnet 30. The energization start position P2 is set oft the basis of the current engine speed in addition to the target seating position P1 and the estimation value of the protruding speed that are described above, as an example. The current engine speed is obtained by the use of the crank angle sensor 42. To be more specific, a movement amount (a stroke amount) of the engagement pin 28 obtained when the engagement pin 28 moves so as to be seated on the forward outer peripheral surface from a state of the engagement pin 28 being seated on the electromagnet 30 is already known. The time required to move the engagement pin 28 by this stroke amount can be calculated on the basis of the stroke amount and the protruding speed. Also, a crank angle period $\alpha$ that is associated with this required time can be determined by the use of the engine speed. Thus, a crank angle position that is advanced by the crank angle period $\alpha$ with respect to the target seating position P1 can be calculated as the energization start position P2.

(Energization Instruction)

The ECU 40 starts the energization to the electromagnet 30 (more specifically, the application of the applied electric voltage shown in FIG. 6) when a calculated energization start position P2 comes. Thus, the cam switching operation can be performed by the use of the outer-periphery seating.

4. Advantageous Effects of Energization Control of Actuator According to First Embodiment If the above-described energization control of the actuator 24 is performed to seat the engagement pin 28 on the forward outer peripheral surface, the engagement pin 28 is temporarily seated on the forward outer peripheral surface and then inserted into the insert section of the cam groove 26 as a result of the rotation of the camshaft 12 as shown in FIG. 6. According to this kind of outer-periphery seating, with the engagement pin 28 being temporarily seated on the forward outer peripheral surface, the stroke amount of the engagement pin 28 can be reduced when the engagement pin 28 is thereafter protruded toward the bottom surface of the insert section of the cam, groove 26 from the forward outer peripheral surface as compared to when the deep-groove seating is performed. Moreover, the protruding speed of the engagement pin 28 becomes zero temporarily when the engagement pin 28 is seated on the forward outer peripheral surface. Due to these reasons, the protruding speed can be decreased when the engagement pin 28 is seated on the bottom surface of the cam groove 26 thereafter. In contrast to this, if the deep-groove seating is used, the speed of the engagement pin 28 is not decreased in the course of the protruding operation. Thus, according to the outer-periphery seating, a seating noise that occurs when the engagement pin 28 is seated on the bottom surface of the cam groove 26 can be reduced as compared to that in using the deep-groove seating. Furthermore, since the stroke amount of the 28 obtained when the engagement pin 28 is seated on the forward outer peripheral surface is smaller, a seating noise that occurs when the engagement pin 28 is seated in this way becomes smaller.

As described so far, according to the present embodiment, the "outer-periphery seating" is used in causing the cam switching device 20 to perform the cam switching operation. Thus, a collision noise (seating noise) that occurs as a result of the protruding operation of the engagement pin 28 can be suppressed and reduced.

Second Embodiment

Next, a second embodiment according to the present disclosure will be described with reference to FIGS. 7 to 9.

1. Configuration of Internal Combustion Engine System and Cam Switching Operation According to Second Embodiment In the following description, it is assumed that the configuration shown in FIG. 1 is used as an example of the configuration of an internal combustion engine system according to the second embodiment. Moreover, the cam switching operation according to the present embodiment is similar to the cam switching operation according to the first embodiment except for the energization control of the actuator 24 described below.

2. Energization Control of Actuator According to Second Embodiment

2-1. Problem on Outer-Periphery Seating at High Engine Speeds

Figure 7:
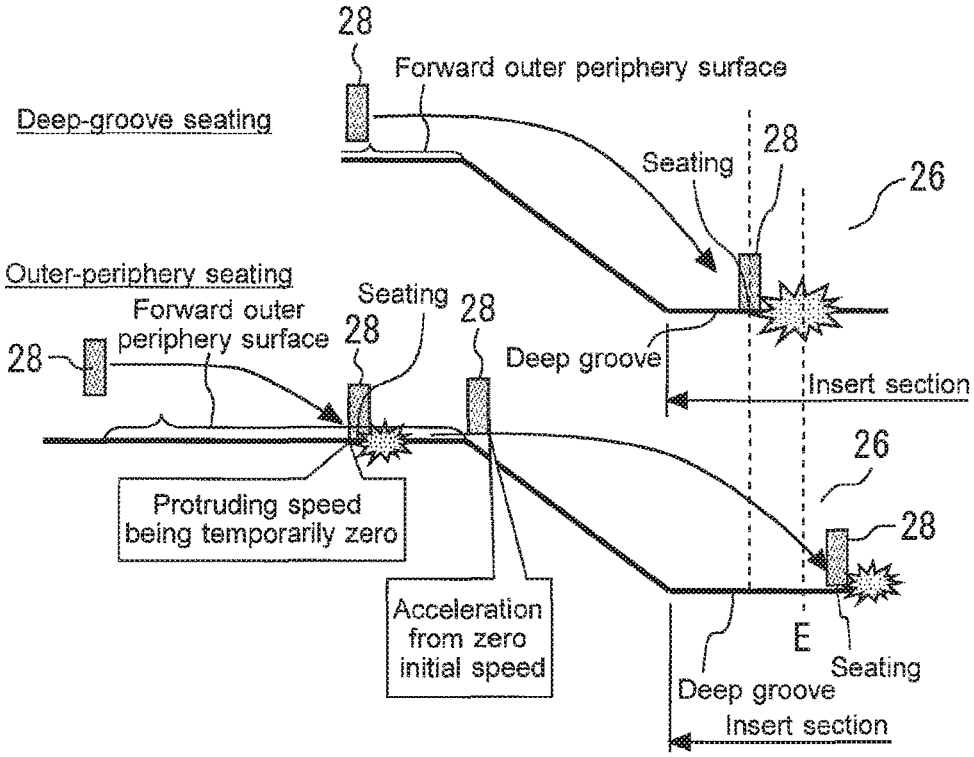
FIG. 7 is a diagram for describing a problem on an outer-periphery seating at high engine speeds.

FIG. 7 is a diagram for describing a problem on an outer-periphery seating at high engine speeds. FIG. 7 represents, under high engine speeds, an example in which the protruding operation of the engagement pin 28 is performed by the use of the deep-groove seating and an example in which the protruding operation of the engagement pin 28 is performed by the use of the outer-periphery seating.

In order to achieve the cam switching operation, it is required to surely insert the engagement pin 28 into the insert section of the cam groove 26. In this regard, if the engine speed is higher, the amount of change of the crank angle per unit time and the amount of change of the cam angle in accompaniment with this become greater. Thus, when considered on a time basis, if the engine speed is higher, the time allowed for the insertion of the engagement pin 28 into the insert section becomes shorter. A crank angle position F shown in FIG. 7 indicates an end of the insert section on the side of the switching section.

With the outer-periphery seating being used, a collision noise (seating noise) that occurs as a result of the protruding operation of the engagement pin 28 can be suppressed and reduced as described in the first embodiment. However, as described in the first embodiment and also shown in FIG. 7, the protruding speed of the engagement pin 28 becomes zero temporarily when the engagement pin 28 is seated on the forward outer peripheral surface. As a result, the engagement pin 28 accelerates again from a zero acceleration state as shown in FIG. 7 when the engagement pin 28 has passed through the forward outer peripheral surface. In this way, due to the effects of the protruding speed of the engagement pin 28 temporarily becoming zero, the time required to protrude the engagement pin 28 into the bottom surface of the cam groove 26 may become longer when the outer-periphery seating is used as compared to when the deep-groove seating is used.

As described above, if the engine speed is higher, the time allowed for the insertion of the engagement pin 28 into the insert section becomes shorter. Thus, as the examples shown in FIG. 7, when the outer-periphery seating is used at high engine speeds, it easily becomes difficult to complete the insertion of the engagement pin 28 into the cam groove 26 until the crank angle position E that corresponds to the end of the insert section comes, as compared to when the deep-groove seating is used. That is, if the outer-periphery seating is used regardless of whether the engine speed NE is higher or lower, it becomes difficult to ensure the feasibility of the cam switching operation at higher engine speeds as compared to at lower engine speeds.

2-2. Switching of Manner of Seating According to Engine Speed NE

In view of the problem described above, in the present embodiment, in causing the cam switching device 20 to perform the cam switching operation, the "outer-periphery seating" is used if the engine speed NE is lower than a certain threshold value NEth and, on the other hand, the "deep-groove seating" is used if the engine speed NE is equal to or greater than the threshold value NEth.

2-3. Processing of ECU Concerning Energization Control of Actuator According to Second Embodiment FIG. 8 is a flow chart that illustrates a routine of the processing concerning the energization control of the actuator 24 according to the second embodiment of the present disclosure. It should be noted that the present routine is repeatedly executed at a predetermined control cycle for each cylinder during operation of the internal combustion engine.

Figure 8:
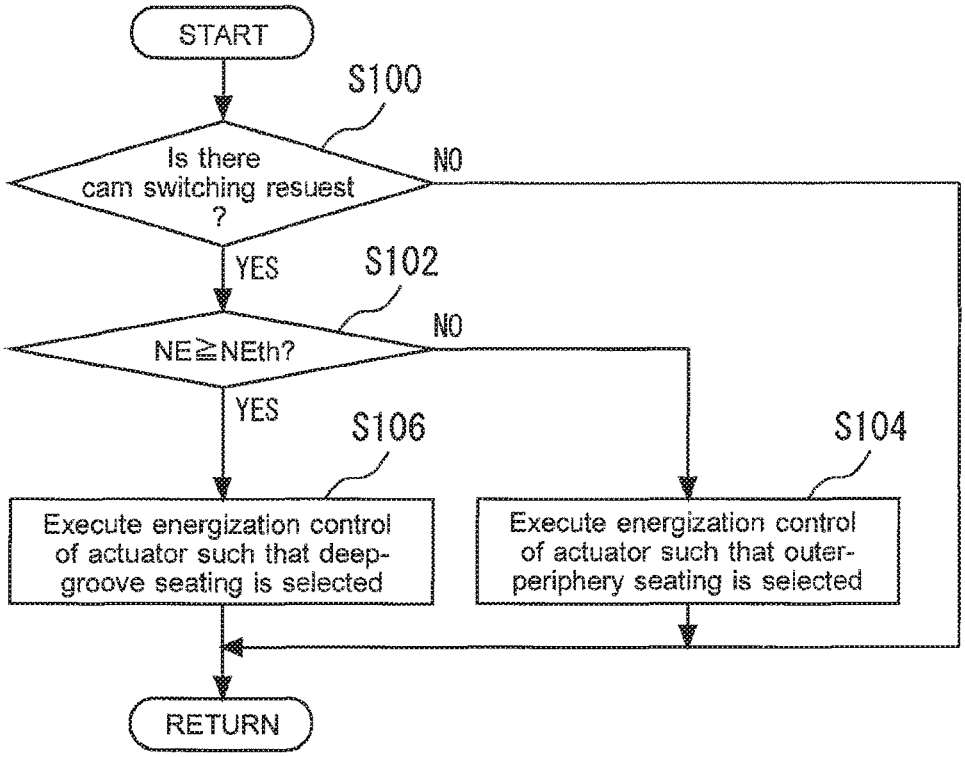
FIG. 8 is a flow chart that illustrates a routine of the processing concerning energization control of the actuator according to a second embodiment of the present disclosure.

In the routine shown in FIG. 8, first, the ECU 40 determines whether or not there is a cam switching request (step S100). Whether or not there is a cam switching request is determined, for example, on the basis of whether or not there is a change of a requested intake cam (i.e., small cam 14 or large cam 16) as a result of a change of the engine operating condition (mainly, engine load and engine speed). Moreover, for example, when a change rate of the required torque has exceeded a certain value during use of the intake cam (small cam) 14, it is determined that there is a request for the switching to the intake cam (large cam) 16.

If the ECU 40 determines in step S100 that there is not a cam switching request, it ends the current processing cycle of the present routine. If, on the other hand, the ECU 40 determines that there is a cam switching request, it then determines whether or not the engine speed NE is equal to or greater than the threshold value NEth (step S102). This threshold value NEth is determined in advance, for example, in consideration of the viewpoint of the quietness (i.e., the vibration and noise performance) required to the internal combustion engine and the viewpoint of the feasibility of the cam switching operation. The threshold value NEth is a fixed value as an example.

If the ECU 40 determines in step S102 that the engine speed NE is lower than the threshold value NEth, it then executes the energization control of the actuator 24 such that the outer-periphery seating is selected (step S104). The energization control for achieving the outer-periphery seating can be performed, for example, in the manner performed in the first embodiment with reference to FIG. 6.

If, on the other hand, the ECU 40 determines in step S102 that the engine speed NE is equal to or greater than the threshold value NEth, it executes the energization control of the actuator 24 such that the deep-groove seating is selected (step S106).

Figure 9:
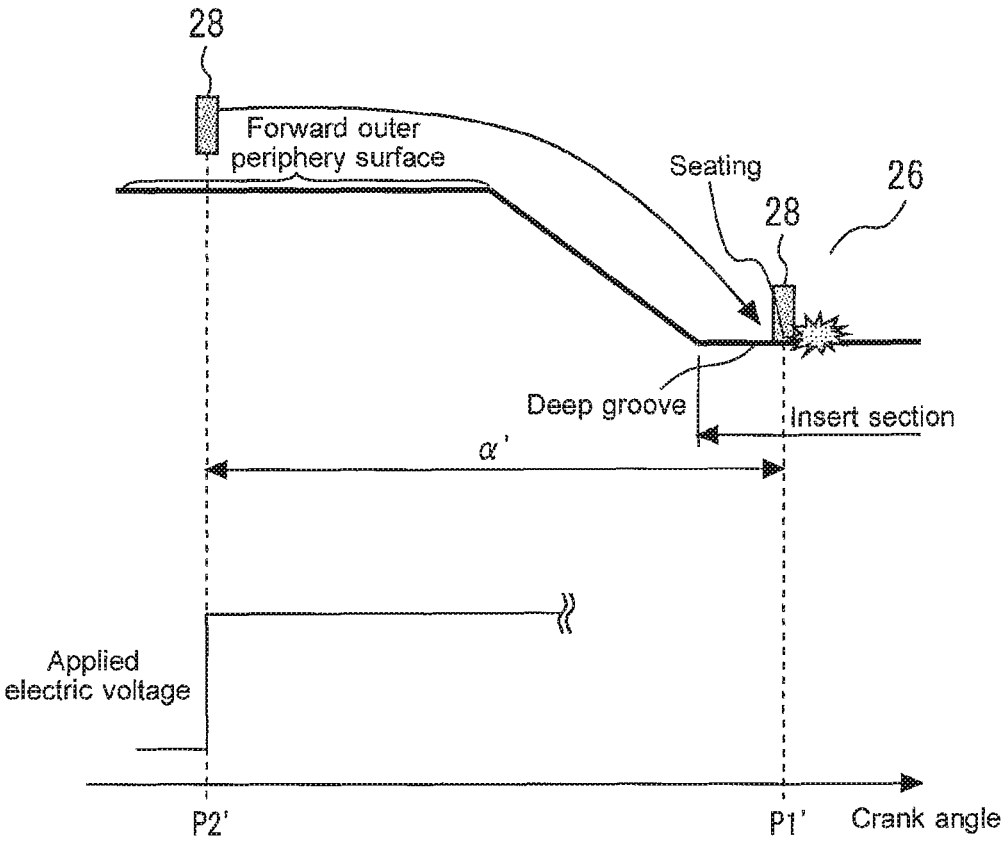
FIG. 9 is a diagram for describing an example of the energization control of the actuator for using a deep-groove seating.

FIG. 9 is a diagram for describing an example of the energization control of the actuator 24 for using the deep-groove seating. The example of the energization control shown in FIG. 9 is basically similar to the example of the energization control for achieving the outer-peripheral seating described in the first embodiment, except that the manner of the setting of a target seating position P1= is mainly different from the setting of the target seating position P1.

That is, the target seating position P1' is selected in the insert section of the cam groove 26 as shown in FIG. 9. As an example of the target seating position P1', a value (more specifically, a crank angle position) determined in advance in consideration of parameters, such as variation of the operation of the engagement pin 28, can be used as with the target seating position P1.

It should be noted that the example of the deep-groove seating is different from the example of the outer-periphery seating in that the stroke amount of the engagement pin 28 that is used in the course of the calculation of a crank angle period $\alpha'$ corresponding to the crank angle period $\alpha$ in the example of the outer-periphery seating becomes equal to the amount of movement from the position at which the engagement pin 28 is seated on the electromagnet 30 to a position at which the engagement pin 28 is seated on the bottom surface of the cam groove 26.

In step S106, the ECU 40 starts the energization to the electromagnet 30 (more specifically, the application of the applied electric voltage shown in FIG. 9) when an energization start position P2' calculated using the method shown in FIG. 9 comes. Thus, the cam switching operation can be performed by the use of the deep-groove seating.

4. Advantageous Effects of Energization Control of Actuator According to Second Embodiment According to the energization control of the actuator 24 of the present embodiment described so far, the "outer-periphery seating" is selected if the engine speed NE is lower than the threshold value NEth and, on the other hand, the "deep-groove seating" is selected if the engine speed NE is equal to or greater than the threshold value NEth. In other words, the target seating position (P1 or P1') is changed between the forward outer peripheral surface and the bottom surface of the insert section of the cam groove 26 in accordance with whether or not the engine speed NE is equal to or greater than the threshold value NEth.

At lower engine speeds, since the overall noise of the internal combustion engine is smaller than that at higher engine speeds, a collision noise (seating noise) of the engagement pin 28 sounds relatively loudly to a passenger of the vehicle. As just described, the problem on the collision noise of the engagement pin 28 markedly occurs at lower engine speeds. On the other hand, at higher engine speeds, as already described, it becomes difficult to ensure the feasibility of the cam switching operation that uses the outer-periphery seating as compared to at lower engine speeds. In view of these points, according to the control of the present embodiment, the outer-periphery seating is used at low engine speeds. Thus, the cam switching operation can be performed in a manner that is relatively easy to ensure the feasibility of the cam switching operation and that is appropriate at low engine speeds at which a reduction of the collision noise of the engagement pin 28 is highly required (that is, a manner that places a significance on the quietness). On the other hand, at high engine speeds, the deep-groove seating is used. According to the deep-groove seating by which the speed of the engagement pin 28 does not decrease in the course of the protruding operation, the engagement pin 28 can be quickly protruded toward a target seating position. Thus, the cam switching operation can be performed in a manner in which a request of a reduction of the collision noise of the engagement pin 28 is relatively low and that is appropriate to high engine speeds in which a request of ensuring the feasibility of the cam switching operation is relatively high (that is, a manner that places a significance on the feasibility of the cam switching operation).

As described so far, the switching of the seating positions depending on the engine speed NE in the present embodiment can perform the cam switching operation that places a significance on the improvement of the quietness at low engine speeds in which reduction of the collision noise is highly requested, while properly ensuring the feasibility of the cam switching operation at high engine speeds as compared to the first embodiment.

(Another Example of Setting of Threshold Value NEth)

In the second embodiment described above, the example has been taken in which the threshold value NEth of the engine speed NE used to switch the manner of the seating is a preset fixed value. However, the threshold value NEth may also be set as follows, for example. That is, as already described, if the viscosity of the oil for lubricating each parts of the internal combustion engine (including each parts of the variable valve operating device 10, such as the camshaft 12) is low due to the temperature of the oil being low, the protruding operation of the engagement pin 28 is easy to be hampered by the oil. Accordingly, the threshold value NEth may also be changed in accordance with the temperature of the aforementioned oil obtained when the cam switching request is made. In detail, the threshold value NEth may also be, for example, changed in accordance with the temperature of the oil in such a manner that a threshold value NEth1 used when the temperature of the oil is a first temperature value is smaller than a threshold value NEth2 used when the temperature of the oil is a second temperature value that is greater than the first temperature. According to this kind of control example, the threshold value NEth can be determined in consideration of also the effects of the temperature (viscosity) of the oil to the protruding operation of the engagement pin 28. Thus, the manner of the seating that is appropriate for an engine speed NE currently in use can be selected as described above, while more properly improving the feasibility of the cam switching operation with the outer-periphery seating.

(Other Examples of Energization Control of Actuator)

In the second embodiment described above, the target seating position (P1 or P1') is changed in accordance with which of the outer-periphery seating or the deep-groove seating is requested, and the energization start position (P2 or P2') is changed on the basis of the target seating position that is set. However, the control of the actuator 24 for enabling to selectively perform one of the outer-periphery seating and the deep-groove seating is not limited to the example described above. That is, the control of the actuator 24 for changing the seating position may be control of the electric current that flows through the electromagnet 30 to change the protruding speed of the engagement pin 28, instead of, or in addition to the control of the energization start position described above. The reason why is that the protruding speed changes as a result of a change of the aforementioned electric current. To be more specific, the control of this electric current can be performed, for example, by changing the magnitude of the applied electric voltage. Moreover, in an example in which duty control for the applied electric voltage is performed, the electric current may also be changed by changing the duty ratio.

(Cam Switching Operation on Cylinder Group Basis)

In the first and second embodiments described above, the configuration including, in each cylinder, the cam carrier 22 on which the plurality of intake cams 14 and 16 and the cam groove 26 are formed and the actuator 24 associated with the cam carrier 22 has been taken as an example. In other words, the configuration in which the cam switching operation is performed for each cylinder has been taken as an example. However, this kind of cam carrier and actuator may alternatively be installed for each of cylinder groups that are composed of two or more cylinders. To be more specific, the alternative cam switching device is required to be configured such that the cam carrier slides in the course of an engagement pin passing through a common base circle section of cams of a plurality of cylinders included in a cylinder group that performs the switching.

(Example of Cam Switching Device that Performs Cam Switching Operation without Sliding Operation of Cam)

In the cam switching device 20 according to the first and second embodiments described above, the engagement pin 28 engaged with the cam groove 26 is built into the actuator 24 attached to the stationary member 27, such as the cylinder head. Also, the cam switching device 20 is configured such that, when the engagement pin 28 is engaged with the cam groove 26 in the switching section, the intake cams 14 and 16 that are fixed to the cam carrier 22 slide in association with the rotation of the camshaft 12 and that, as a result, the cam that drives the intake valve is switched. However, in the cam switching device intended for the present disclosure, the sliding of the cam itself is not always required, as far as the engagement pin is inserted into the cam groove in response to the operation of the actuator and, as a result, the cam that drives the valve is switched. Also, the present disclosure is applicable, as far as a collision noise occurs in the course of the engagement pin being inserted into the cam groove as a result of the operation of the actuator. Thus, the cam switching device may also be configured as disclosed in WO 2011064852 A1, for example.

The outline of the configuration of a cam switching device disclosed in WO 2011064852 A1 is described below. That is, according to this cam switching device, a cam groove (i.e., a spiral guide rail) is formed at a cylindrical part that is fixed (formed) at a part of a camshaft. Also, in this cam switching device, a sliding member (a slide pin) capable of sliding in a direction parallel to the axial direction of the camshaft is arranged between a lock pin (which is not an "engagement pin" engaged with the cam groove) that is built in an electromagnetic solenoid type actuator and the cam groove. An engagement pin (a projection part) engaged with the cam groove is formed on this sliding member. Moreover, according to this cam switching device, if the energization to the actuator is performed, the sliding member is pushed by the lock pin that is built in the actuator, and, as a result, the engagement pin (projection part) of the sliding member is protruded toward the outer peripheral surface of the camshaft and is inserted into the cam groove. As a result, the sliding member slides in the direction parallel to the axial direction of the camshaft in association with the rotation of the camshaft. In accompaniment with this, the operational state of a rocker arm that is interposed between a plurality of cams and a valve is switched, and the cam that drives the valve is thereby switched.

According to the cam switching device disclosed in WO 2011064852 A1, when the distal end of the engagement pin of the sliding member pushed by the actuator with the lock pin as described above comes into collision with the bottom surface of the cam groove, or when the surface of the base end of the engagement pin comes into contact with the outer peripheral surface of the cylindrical part near the cam groove, a collision noise occurs as a result of a protruding operation. In further addition to this, the engagement pin may not be always built in the actuator as with the cam switching device disclosed in WO 2011064852 A1. Moreover, the cam groove may not be always formed on the outer peripheral surface of a cam carrier (that serves as a part of the outer peripheral surface of a camshaft) that is separated from the camshaft as with the variable valve operating device 10, and may alternatively be formed at the outer peripheral surface of the cylindrical part (that serves as a part of the outer peripheral surface of the camshaft) that is formed (fixed) at a part of the camshaft as with the cam switching device disclosed in WO 2011064852 A1. Furthermore, the number of the engagement pins provided for each cylinder or each cylinder group may not be always plural as with the engagement pin 28 of the variable valve operating device 10, and may be one as with the cam switching device disclosed in WO 2011064852 A1.

The embodiments and modifications described above may be combined in other ways than those explicitly described above as required and may be modified in various ways without departing from the scope of the present disclosure.

What is claimed is:

1. An internal combustion engine system, comprising:

a camshaft which is driven to rotate;

a plurality of cams which are provided at the camshaft and whose profiles are different from each other;

a cam switching device configured to perform a cam switching operation that switches, between the plurality of cams, a cam that drives a valve that opens and closes a combustion chamber; and an electronic control unit configured to control the cam switching device, wherein the cam switching device includes:

a cam groove which is provided on an outer peripheral surface of the camshaft; and an actuator which is equipped with an engagement pin engageable with the cam groove, the actuator selectively causing the engagement pin to protrude toward the camshaft, wherein the cam switching device is configured such that, while the engagement pin is engaged with the cam groove, the cam that drives the valve is switched between the plurality of cams in association with a rotation of the camshaft, wherein the outer peripheral surface of the camshaft includes a forward outer peripheral surface which is located more forward than an end of the cam groove on a forward side in a rotational direction of the camshaft, wherein the electronic control unit is configured, in causing the cam switching device to perform the cam switching operation, to control the actuator such that the engagement pin is seated on the forward outer peripheral surface, and wherein, in causing the cam switching device to perform the cam switching operation, the electronic control unit is configured, when an engine speed is lower than a threshold value, to control the actuator such that the engagement pin is seated on the forward outer peripheral surface, and is configured, when the engine speed is equal to or higher than the threshold value, to control the actuator such that the engagement pin is inserted into the cam groove without being seated on the forward outer peripheral surface.

2. The internal combustion engine system according to claim 1, wherein the threshold value is a first threshold value when a temperature of an oil that lubricates the camshaft is a predetermined temperature value, and the threshold value is a second threshold value, which is greater than the first threshold value, when the temperature of the oil is greater than the predetermined temperature value.

* * * * *